US006837003B2

(12) United States Patent
Nien

(10) Patent No.: US 6,837,003 B2
(45) Date of Patent: Jan. 4, 2005

(54) WOODEN SHUTTER

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/340,623

(22) Filed: Jan. 13, 2003

(65) Prior Publication Data

US 2004/0065015 A1 Apr. 8, 2004

(30) Foreign Application Priority Data

Oct. 8, 2002 (TW) ..... 91215912 U

(51) Int. Cl.[7] ..... E05B 65/04
(52) U.S. Cl. ..... 49/67; 49/388
(58) Field of Search ..... 49/74.1, 63, 67, 49/381, 388, 390, 397, 402, 400; 16/378

(56) References Cited

U.S. PATENT DOCUMENTS 2,603,822 A * 7/1952 Evans ..... 16/263
2,835,359 A * 5/1958 Boldt et al. ..... 49/402
3,604,154 A * 9/1971 Curran ..... 49/501
4,754,524 A * 7/1988 Bullock et al. ..... 16/273

* cited by examiner

*Primary Examiner*—Jerry Redman

(57) ABSTRACT

A wooden shutter. The wood shutter is installed on the wall around a window and includes an outer frame having a receiving open space and top and mounting portions at top and bottom ends of one side thereof. Louvers are arranged in parallel in the receiving open space within the outer frame. A first coupling unit and a second coupling unit are fixedly fastened to the wall around the window respectively. The first coupling unit has a fixed pivot pivoted to the bottom mounting portion of the outer frame. The second coupling unit has a movable pivot member detachably inserted through a through hole thereof for detachably pivoting to the top mounting portion of the outer frame for enabling the outer frame to be turned about the fixed pivot member and the movable pivot member in and out of the window.

14 Claims, 9 Drawing Sheets

WOODEN SHUTTER

BACKGROUND OF THE INVENTION

1. Field of the Invention

The present invention relates to a window covering and, more particularly, to a wooden shutter for a window.

2. Description of the Related Art

A conventional wooden shutter, as shown in FIG. 1, is generally comprised of an outer frame 1, a set of louvers 2, and a control rod 3. The outer frame 1 is a rectangular open frame. The louvers 2 are transversely arranged in parallel within the outer frame 1. The control rod 3 is coupled to one lateral side of each of the louvers 2 for operation by hand to tilt the louvers 2 and to adjust the gap between each two adjacent louvers 2. Before installation of the shutter in a window, ornamental strips 4 are fixedly fastened to the wall around the four sides of the window, and then hinges 5, for enabling the shutter to be turned in and out of the window, hinge one vertical side of the outer frame 1 to one vertical extended ornamental strip 4. This structure of down shutter is still not satisfactory in function because of the following drawbacks.

1. Because the hinges 5 are visible when fastened to the outer frame 1 and the ornamental strip 4 (see FIG. 1), they destroy the sense of beauty of the wooden shutter. Further, only a specially trained technician can accurately install the hinges 5 in position. If the hinges 5 are not accurately installed in position, the wooden shutter cannot be smoothly opened and closed.

2. Before installation of the ornamental strip 4, the wall must be polished so that the ornamental strip 4 can closely attached to the wall. This polishing job requires techniques. The user may have to hide a professional technician to do the job.

3. The wooden shutter is expensive because it is made subject to the size of the window in which the wooden shutter is to be installed. Because of custom made, much fabrication and installation time is needed.

4. The ornamental strips provided around the four sides of the window are mitered. If the mitered joint between each two adjacent ornamental strips is not precisely engineered, the mitered joint tends to be damaged during delivery of the wooden shutter, resulting in a bad looking.

5. The ornamental strips 4 are provided to make the wooden shutter look better. However, when a screw nail 6 driven through one ornamental strip 4 into the wall W as shown in FIG. 2, the head 6*a* of the screw nail 6 is exposed to the outside, destroying the sense of beauty of the ornamental strip.

SUMMARY OF THE INVENTION

The present invention has been accomplished under the circumstances in view. It is the main object of the present invention to provide a wooden shutter that has a nice looking when installed.

It is another object of the present invention to provide a simple and inexpensive wooden shutter that can easily detachably installed in the window by the user.

To achieve these objects of the present invention, the wooden shutter comprises an outer frame defining a receiving open space, a plurality of louvers arranged in parallel in the receiving open space, a first coupling unit and a second coupling unit. The outer frame has a top mounting portion and a bottom mounting portion at top and bottom ends of one side thereof. The first coupling unit has a mounting plate fixedly fastened to the wall around the window and a fixed pivot member fixedly located on the mounting plate and pivoted to the bottom mounting portion of the outer frame. The second coupling unit has a mounting plate fixedly fastened to the wall around the window and a movable pivot member inserted through a hole in the mounting plate and adapted to be detachably pivoted to the top mounting portion of the outer frame for enabling the outer frame to be turned about the fixed pivot member and the movable pivot member in and out of the window.

DETAILED DESCRIPTION OF THE INVENTION

Figure 1:
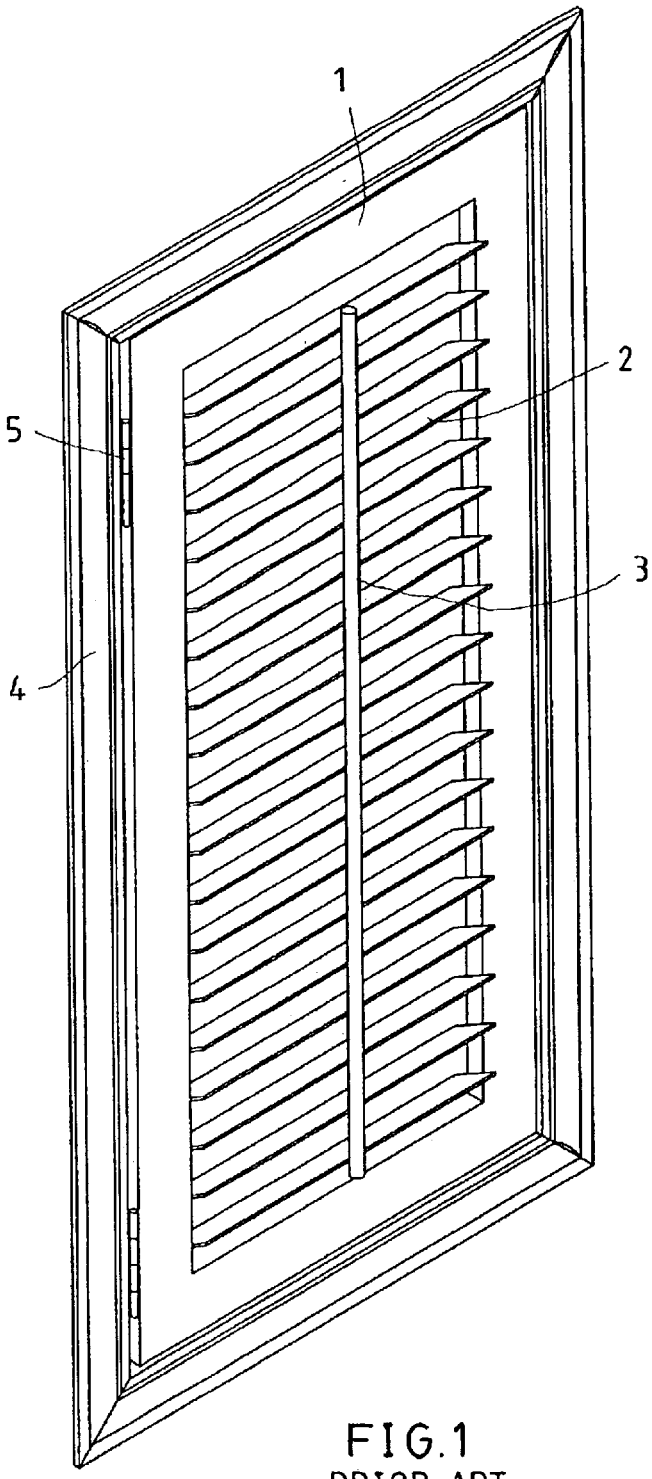
FIG.1 PRIOR ART
FIG. 1 is a perspective view of a wooden shutter according to the prior art.
Figure 2:
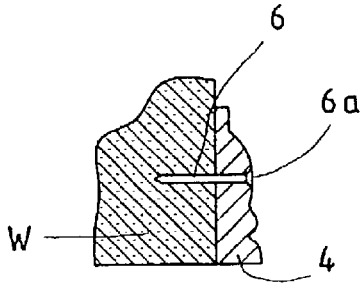
FIG.2 PRIOR ART
FIG. 2 is a schematic sectional view showing the connection between the wooden shutter and the wall according to the prior art.
Figure 3:
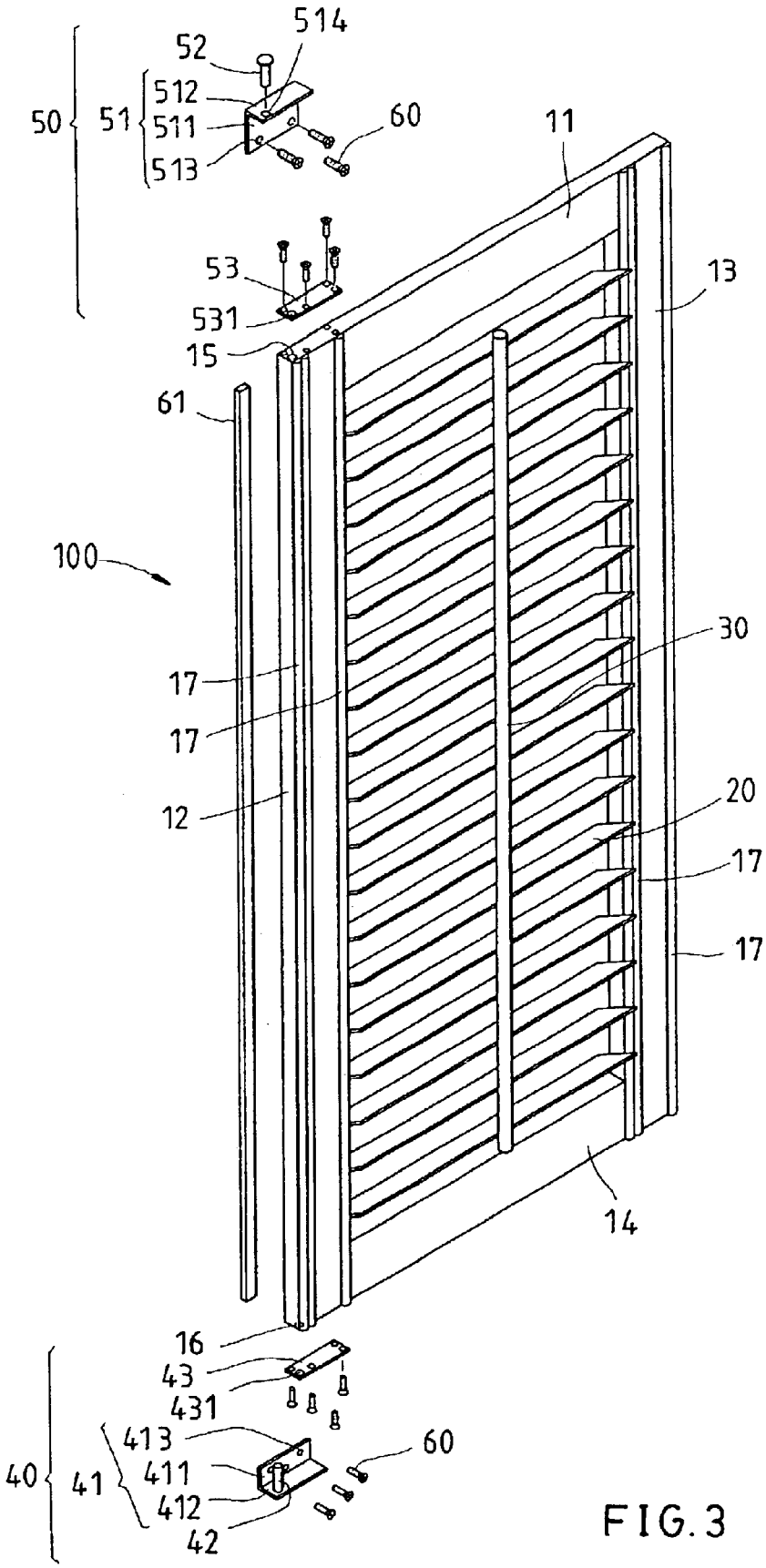
FIG. 3 is an exploded view of a wooden shutter according to a first preferred embodiment of the present invention.
Figure 4:
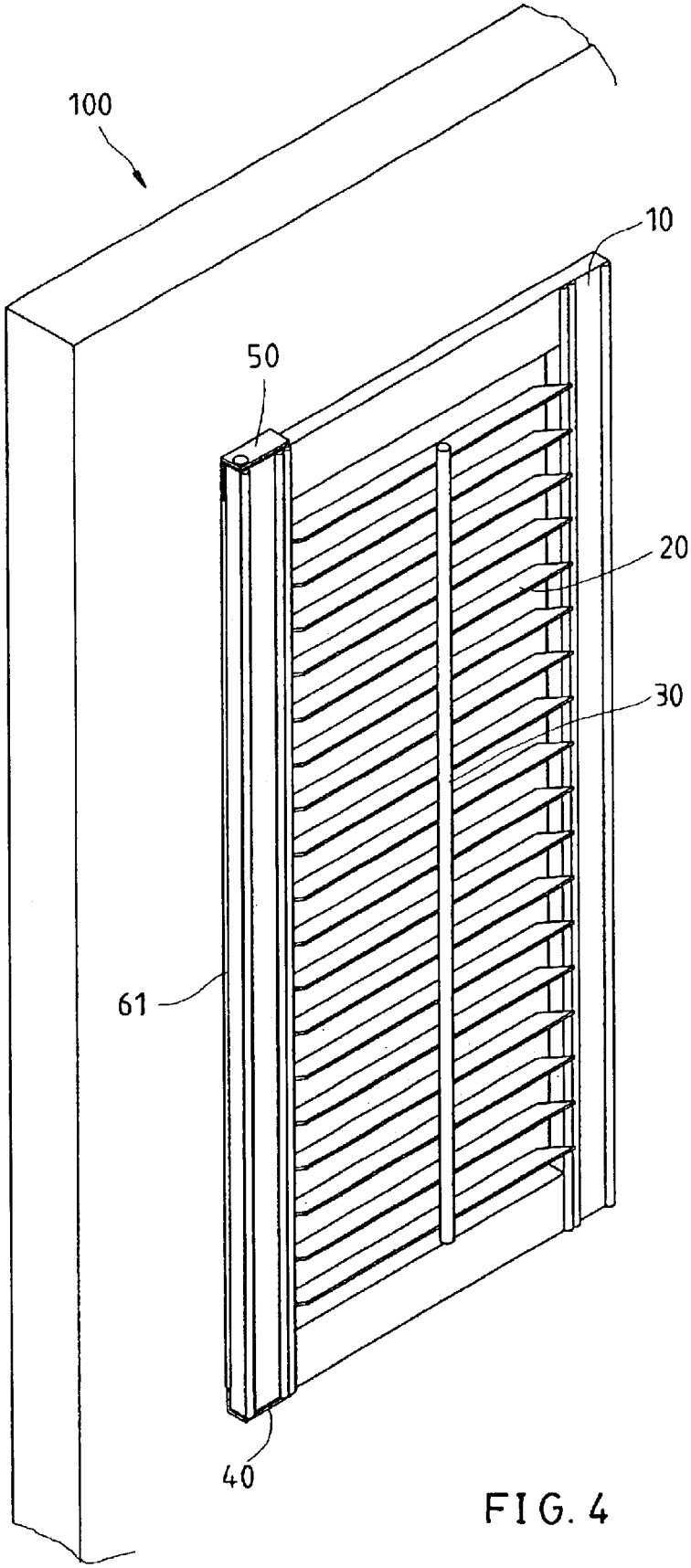
FIG. 4 is a perspective assembly view of the wooden shutter shown according to the first embodiment of the present invention.

Referring to FIGS. 3 and 4, a wooden shutter 100 in accordance with the first preferred of the present invention is shown comprised of an outer frame 10, a set of louvers 20, a control rod 30, a first coupling unit 40, and a second coupling unit 50.

The outer frame 10 is a rectangular open frame comprising a top block 11, a first stile 12, a second stile 13, and a bottom block 14. The top block 1 is a long, narrow plate member transversely extended at the top. The first and second stiles 12 and 13 are vertically arranged in parallel and fixedly connected to the distal ends of the top block 11 in flush with the top of the top block 1. The top and bottom ends of the first stile 12 are respectively terminating in a top mounting portion 15 and a bottom mounting portion 16. The top mounting portion 15 is a recessed portion having a predetermined depth and width. Preferably, the top mounting portion 15 is disposed in the top end of the first stile 12 in close proximity to the front and outer sides of the first stile 12. The bottom mounting portion 16 is a recessed portion having a predetermined depth and width. Preferably, the bottom mounting portion 16 is disposed in the bottom end of the first stile 12 in proximity to the front and outer sides of the first stile 12. Further, the first and second stiles 12 and 13 each have a decorative design of raised lines 17 in the respective front side. The bottom block 14 is a long, narrow plate member transversely connected between the inner sides of the first and second stiles 12 and 13 in flush with the bottom ends of the first and second stiles 12 and 13. The top block 11, the first and second stiles 12 and 13, and the bottom block 14 define a rectangular receiving open space.

The louvers 20 are long, thin, narrow pieces of wood transversely arranged in parallel within the rectangular receiving open space of the outer frame 10 at different elevations, each having two distal ends respectively fastened pivotally with the inner sides of the first and second stiles 12 and 13 of the outer frame 10, for enabling the louvers 20 to be synchronously tilted. The control rod 30 is coupled to the outer lateral sides of the louvers 20 and equally spaced between the stiles 12 and 13 for operation by hand to tilt the louvers 20 and to further adjust the gap between each two adjacent louvers 20.

The first and second coupling units 40 and 50 are connected between the outer frame 10 and the wall around a window to pivotally secure the wooden shutter 100 to the window, for enabling the wooden shutter 100 to be turned in and out of the window. The first coupling unit 40 comprises a mounting plate 41, a fixed pivot member 42, and a packing pad 43. The mounting plate 41 is an angled tough plate having a mounting portion 411 and a bearing portion 412 arranged at right angles. The mounting portion 411 has a plurality of mounting holes 413. The fixed pivot member 42 is a round pivot pin vertically formed integral with the bearing portion 412 at a predetermined location. The packing pad 43 is made of wear resistant material of low friction coefficient and fixedly fastened to the bottom end of the first stile 12 by screws, having a through hole 431 corresponding to the bottom mounting portion 16 of the first stile 12 so that the pivot member 42 can be inserted through the through hole 431 of the packing pad 43 into the bottom mounting portion 16. The second coupling unit 50 comprises a mounting plate 51, a movable pivot member 52, and a packing pad 53. The mounting plate 51 is an angled tough plate having a mounting portion 511 and a bearing portion 512 arranged at right angles. The mounting portion 511 has a plurality of mounting holes 513. The bearing portion 512 has a through hole 514. The movable pivot member 52 is an independent round pivot pin that can be inserted through the through hole 514. The packing pad 53 is made of wear resistant material of low friction coefficient and fixedly fastened to the top end of the first stile 12 by screws, having a through hole 531 corresponding to the top mounting portion 12 of the first stile 12 so that the pivot member 52 can be inserted through the through hole 531 of the packing pad 53 into the top mounting portion 15.

Figure 5:
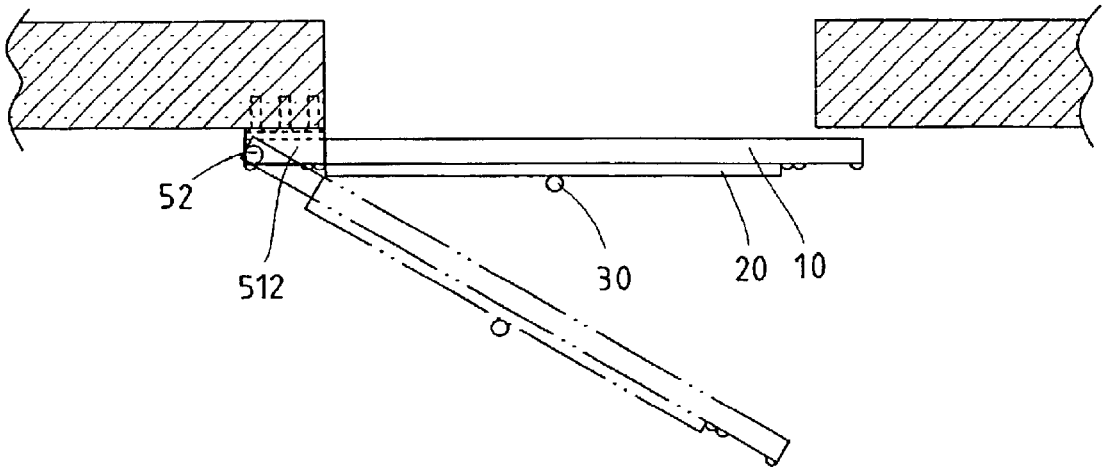
FIG. 5 is a schematic drawing showing the wooden shutter turned in and out between the close position and the open position according to the first embodiment of the present invention.

The installation of the wooden shutter 100 is outlined hereinafter with reference to FIGS. 3~5. According to the present installation example, the wooden shutter 100 is installed in the outer side of the window. At first, the mounting plate 41 of the first coupling unit 40 and the mounting plate 51 of the second coupling unit 50 are respectively attached to the outer surface of the wall around the window near the bottom and top sides of the window, and then fastening elements 60 are respectively inserted into the mounting holes 413 and 513 of the mounting plates 41 and 51 and driven into the wall around the window to fixedly secure the mounting plates 41 and 51 to the wall, and then the top block 11, the stiles 12 and 13, the bottom block 14, the louvers 20, and the control rod 30 are assembled, and then the assembled wooden shutter 100 is set between the bearing portions 412 and 512 of the mounting plates 41 and 51 to force the fixed pivot member 42 through the through hole 431 of the packing pad 43 at the bottom end of the first stile 12 into the bottom mounting portion 16, and then the top mounting portion 15 of the first stile 12 is aimed at the through hole 514 of the bearing portion 512 of the mounting plate 51 of the second coupling unit 50, and then the movable pivot member 52 is inserted through the through hole 514 of the bearing portion 512 and the through hole 531 of the packing pad 53 at the top end of the first stile 12 into the top mounting portion 15. By means of the first coupling unit 40 and the second coupling unit 50, the first stile 12 of the wooden shutter 100 is pivotally fastened to the wall at one side of the window, and the user can turn the wooden shutter 100 about the axis passing through the first stile 12. When wishing to detach the outer frame 10 from the window, remove the movable pivot member 52 from the through hole 514 of the mounting plate 51 of the second coupling unit 50 to disengage the connection between the top mounting portion 15 of the first stile 12 and the mounting plate 51 of the second coupling unit 50, and then the outer frame 10 is pulled upwards to disengage the bottom mounting portion 16 of the first stile 12 from the fixed pivot member 42 at the mounting plate 41 of the first coupling unit 40. By means of the aforesaid arrangement, the user can mount/dismount the wooden shutter 100 easily.

As indicated above, the packing pads 43 and 53 are made of wear resistant material of low friction resistance. When the first stile 12 turned relative to the mounting plates 41 and 51, the packing pads 43 and 53 buffer friction between the first stile 12 and the mounting plates 41 and 51. Therefore, the wooden shutter 100 can smoothly be turned in and out of the window with less effort without noises.

Figure 6:
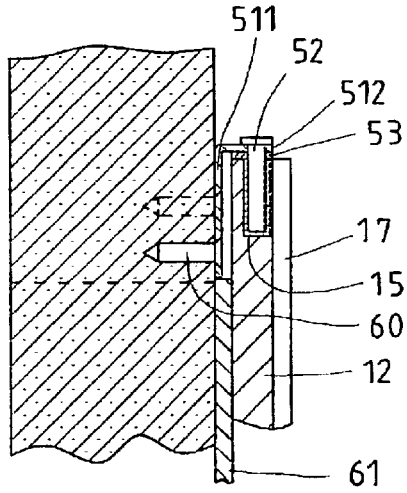
FIG. 6 is a side view in section of a part of the first embodiment of the present invention, showing the connection between the outer frame and the wall.
Figure 7:
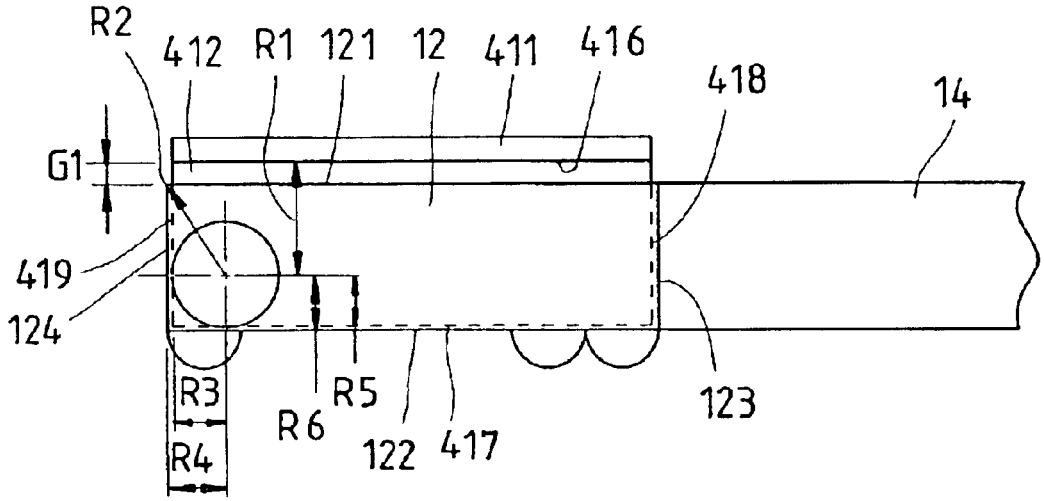
FIG. 7 is a schematic bottom view in an enlarged scale of a part of the first embodiment of the present invention when the outer frame set in the close status.
Figure 8:
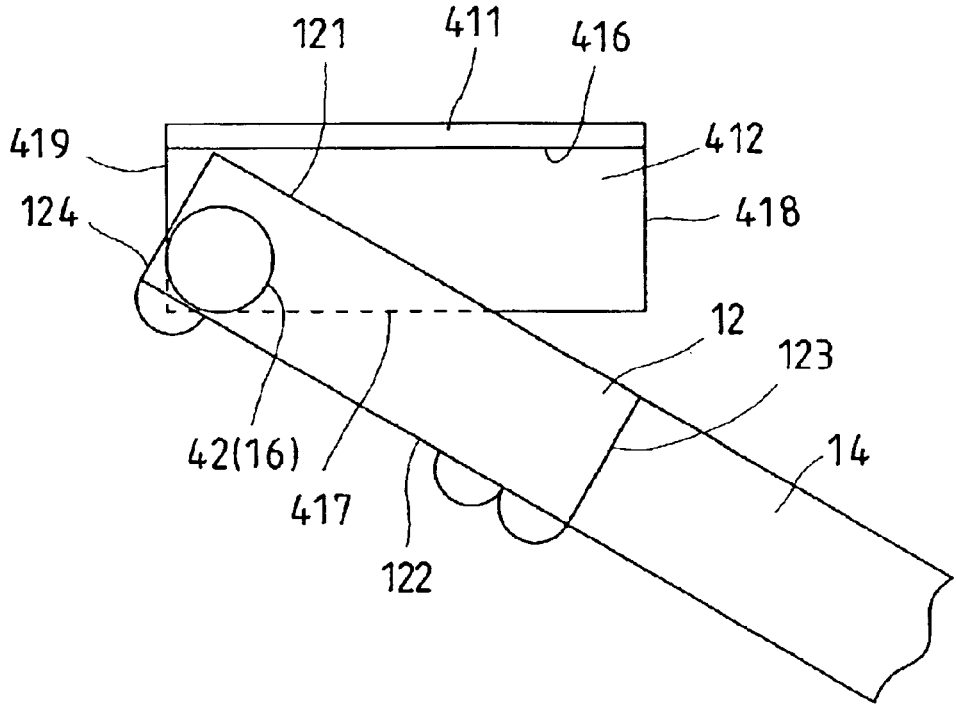
FIG. 8 is a schematic bottom view in an enlarged scale of a part of the first embodiment of the present invention when the outer frame turned out of the window.

Referring to FIG. 6, the outer frame 10 is not directly attached to the wall around the window. The mounting portions 411 and 511 of the mounting plates 41 and 51 keep the outer frame 10 from the wall around the window at a distance. Therefore, the uneven wall surface of the wall around the window does not interfere with the installation of the wooden shutter 100. Because the mounting portions 411 and 511 have a limited thickness, the limited gap between the outer frame 10 and the wall around the window is not obvious. In order to cause a sense of beauty, a flexible packing strip 61 is sealed in the gap between the outer frame 10 and the wall around the window. Preferably, the packing strip 61 is made of rubber or elastic material. Further, the positions of the pivot members 42 and 52 in the mounting plates 41 and 51 of the first and second coupling units 40 and 50 and the positions of the top and bottom mounting portions 15 and 16 in the top and bottom ends of the first stile 12 are so determined that no interference is produced between the outer frame 10 and the mounting plates 41 and 51 upon pivot motion of the outer frame 10. The positions of the related members are defined hereinafter (because the relative position between the movable pivot member 52 and the top mounting portion 15 is similar to the relative position between the fixed pivot member 42 and the bottom mounting portion 15, only the relative position between the fixed pivot member 42 and the bottom mounting portion 16 is described):

Referring to FIGS. 7 and 8, the bearing portion 412 defines a boundary having a first side 416, a second side 417, a third side 418, and a fourth side 419. The first side 416 joins the mounting portion 411. The second side 417 is opposite to the first side 416. The third side 418 is connected between the first side 416 and the second side 417 at an inner side (the right side in FIGS. 7 and 8). The fourth side 419 is connected between the first side 416 and the second side 417 at an outer side (the left side in FIGS. 7 and 8) opposite to the third side 418. When the outer frame 10 set in the close position (in the window), the border of the bottom end of the stile 12 forming the bottom mounting portion 16 defines a fifth side 121, a sixth side 122, a seventh side 123, and an eighth side 124 corresponding to the first side 416, the second side 417, the third side 418, and the fourth side 419 respectively. When the position of the bottom mounting portion 16 of the first stile 12 matches the position of the fixed pivot member 42, i.e., when the outer frame 10 set in the close position (in the window), the distance R1 between the axis of the fixed pivot member 42 and the first side 416 is greater than the distance R2 between the center of the bottom mounting portion 16 and the connection area between the fifth side 121 and the eighth side 124 (the distance R2 is also equal to the maximum radius of gyration of the corner angle of the first stile 12) so that a certain gap is left between the first mounting portion 411 of the mounting plate 41 and the connection area between the fifth side 121 and eight side 124 of the first stile 12 when the first stile 12 turned with the outer frame 10 to any position within about 180° between the close position and the open position (see FIG. 8), preventing interference between the first stile 12 and the mounting plate 41. Further, because the distance R1 is slightly greater than the distance R2, the gap G1 between the first side 416 of the mounting plate 41 and the fifth side 121 of the first stile 12 is maintained minimized when the first stile 12 turned with the outer frame 10 to any position within about 180° between the close position and the open position. Therefore, a nice looking is constantly maintained when the outer frame 10 turned to any angular position between the open status and the close status.

Further, the position of the fixed pivot member 42 in the mounting plate 41 should be close to the second side 417 as well as the fourth side 419 (i.e., the position of the fixed pivot member 42 must be close to the connection area between the second side 417 and the fourth side 419), keeping the distance R3 between the axis of the fixed pivot member 42 and the fourth side 419 less than or equal to the distance R4 between the center of the bottom mounting portion 16 and the eighth side 124, so that the fourth side 419 of the mounting plate 41 does not protrude over the eighth side 124 of the first stile 12 when the outer frame 10 turned to the close position (in the window). The distance R5 between the axis of the fixed pivot member 42 and the second side 417 should be smaller than the distance R6 between the center of the bottom mounting portion 16 and the sixth side 122, so that the second side 417 of the mounting plate 41 does not protrude over the sixth side 122 of the first stile 12 when the outer frame 10 turned to the close position (in the window). In other words, when the wooden shutter 100 set in the window, the second side 417 and fourth side 419 of the mounting plate 41 do not protrude over the sixth side 122 and eighth side 124 of the first stile 12, keeping a nice looking.

Figure 9:
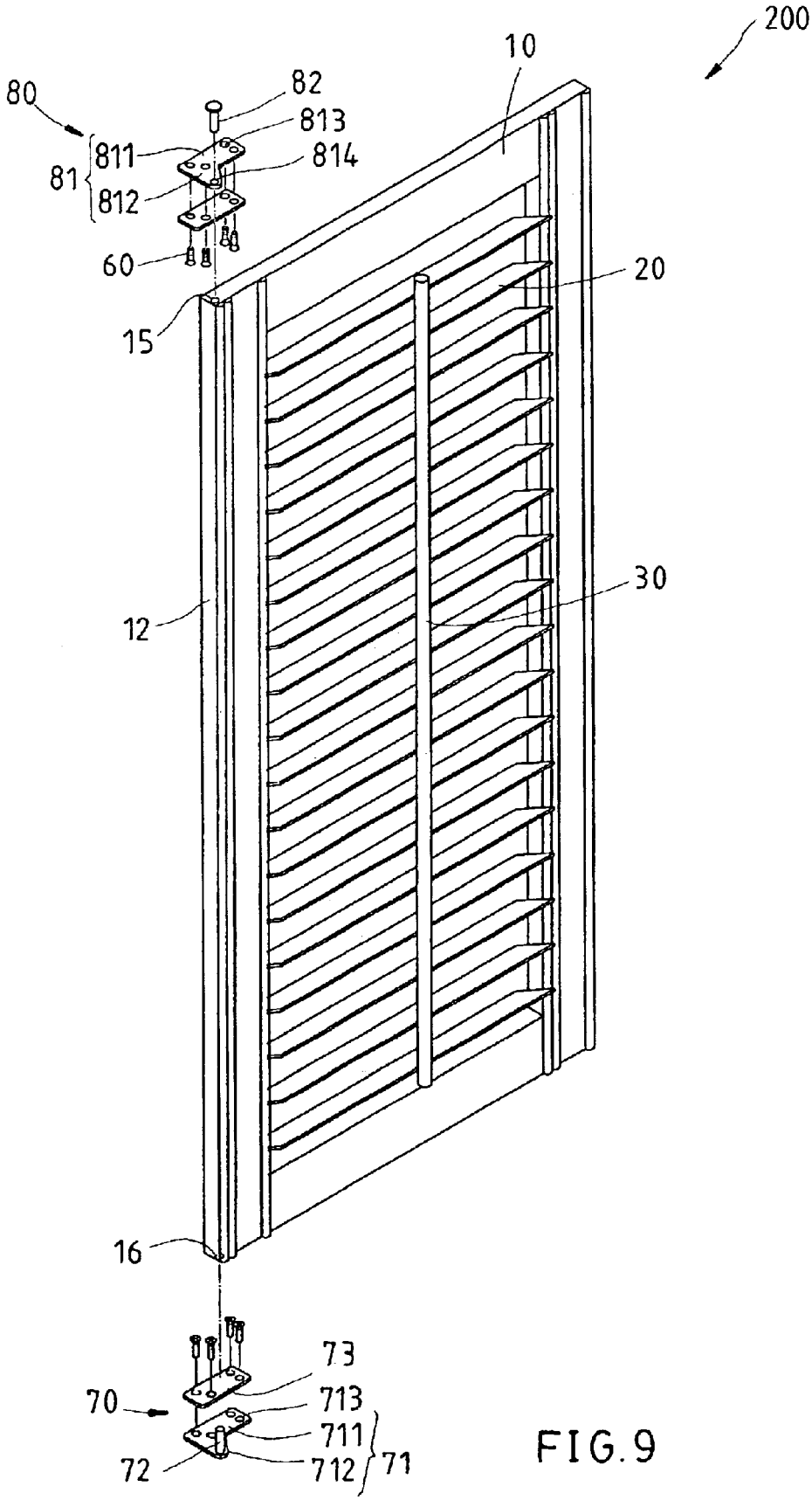
FIG. 9 is an exploded view of a wooden shutter according to a second preferred embodiment of the present invention.
Figure 10:
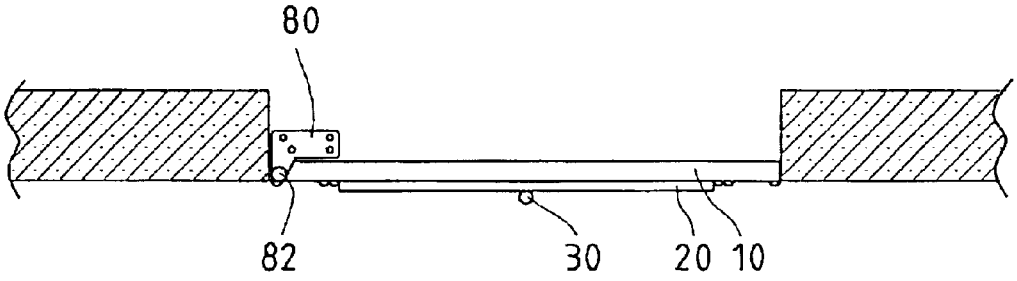
FIG. 10 is a sectional view of the second embodiment of the present invention, showing the wooden shutter installed in the window.

FIGS. 9 and 10 show a wooden shutter 200 according to the second embodiment of the present invention. The wooden shutter 200 is comprised of an outer frame 10, louvers 20, a control rod 30, a first coupling unit 70, and a second coupling unit 80. The first coupling unit 70 is comprised of a mounting plate 71, a fixed pivot member 72, and a packing pad 73. The second coupling unit 80 is comprised of a mounting plate 81, a movable pivot member 82, and a packing pad 83. The main features of this second embodiment are outlined hereinafter.

The mounting portion 711 of the mounting plate 71 of the first coupling unit 70 is a planar plate of tough material having a plurality of mounting holes 713. The bearing portion 712 of the mounting plate 71 is a protruded portion transversely extended from one corner of the mounting portion 711. The fixed pivot member 72 is a round pivot pin fixedly perpendicularly located on the bearing portion 712.

The mounting portion 811 of the mounting plate 81 of the second coupling unit 80 is a planar plate of tough material having a plurality of mounting holes 813. The bearing portion 812 of the mounting plate 81 is a protruded portion transversely extended from one corner of the mounting portion 811, having a through hole 814. The movable pivot member 82 is an independent round pivot pin 72 that can be inserted into or removed from the through hole 814 of the bearing portion 812.

According to this design, the wooden shutter 200 is to be installed in the window from the inside of the house. During installation, the mounting plates 71 and 81 of the first and second coupling units 70 and 80 are respectively fixedly fastened to the top and bottom sides of the peripheral wall around the window by fastening elements 60, and then the top and bottom mounting portions 15 and 16 of the first stile 12 are respectively pivoted to the pivot members 72 and 82 in the same way as the aforesaid first embodiment of the present invention.

Figure 11:
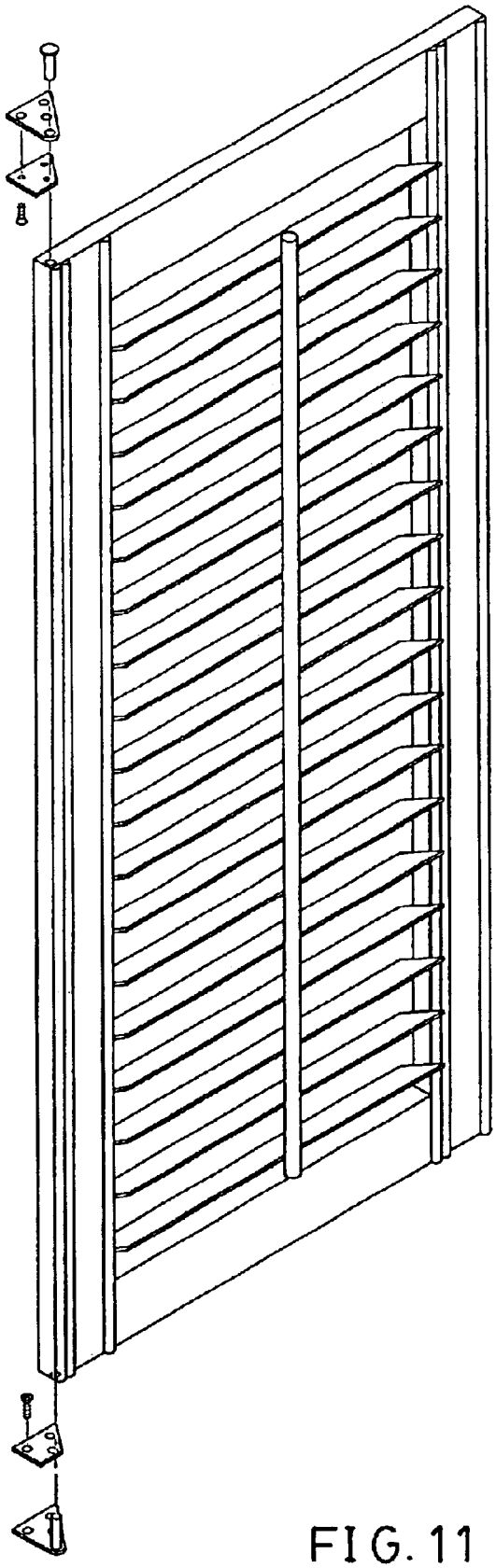
FIG. 11 is an exploded view showing another alternate form of the first and second coupling units according to the present invention.
Figure 12:
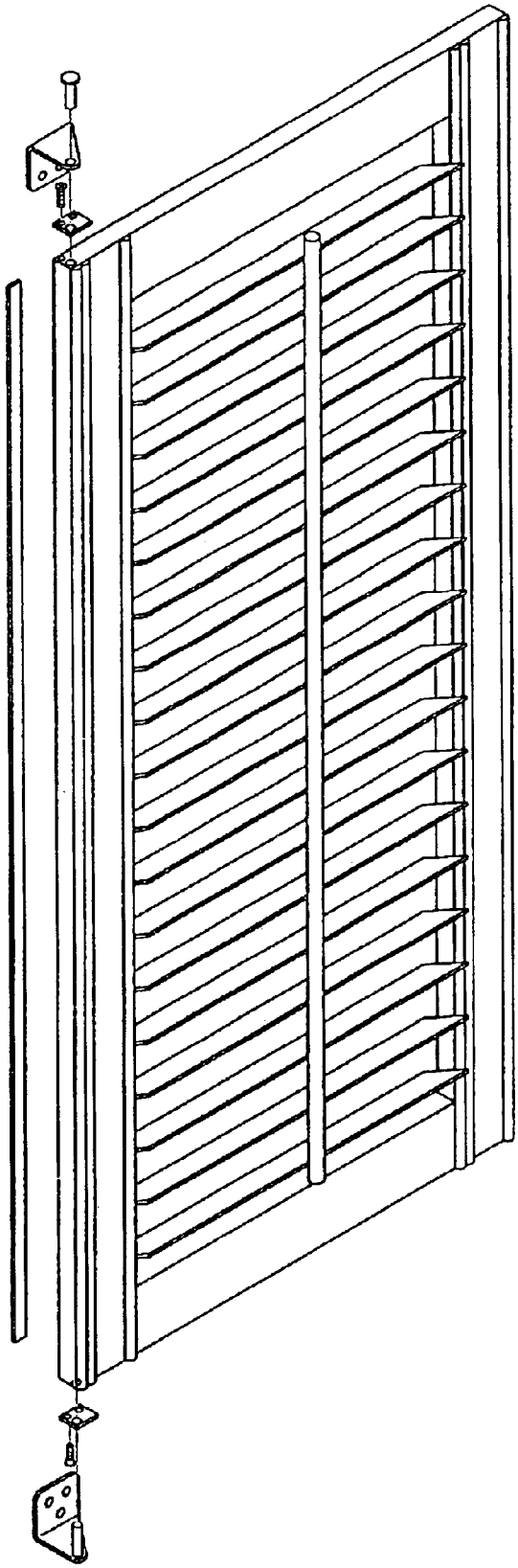
FIG. 12 is an exploded view showing still another alternate form of the first and second coupling units according to the present invention.

Besides the aforesaid first and second embodiments, the mounting plates of the first and second coupling units may be variously shaped. FIGS. 11 and 12 show another two alternate forms of the mounting plates of the first and second coupling units.

Figure 13:
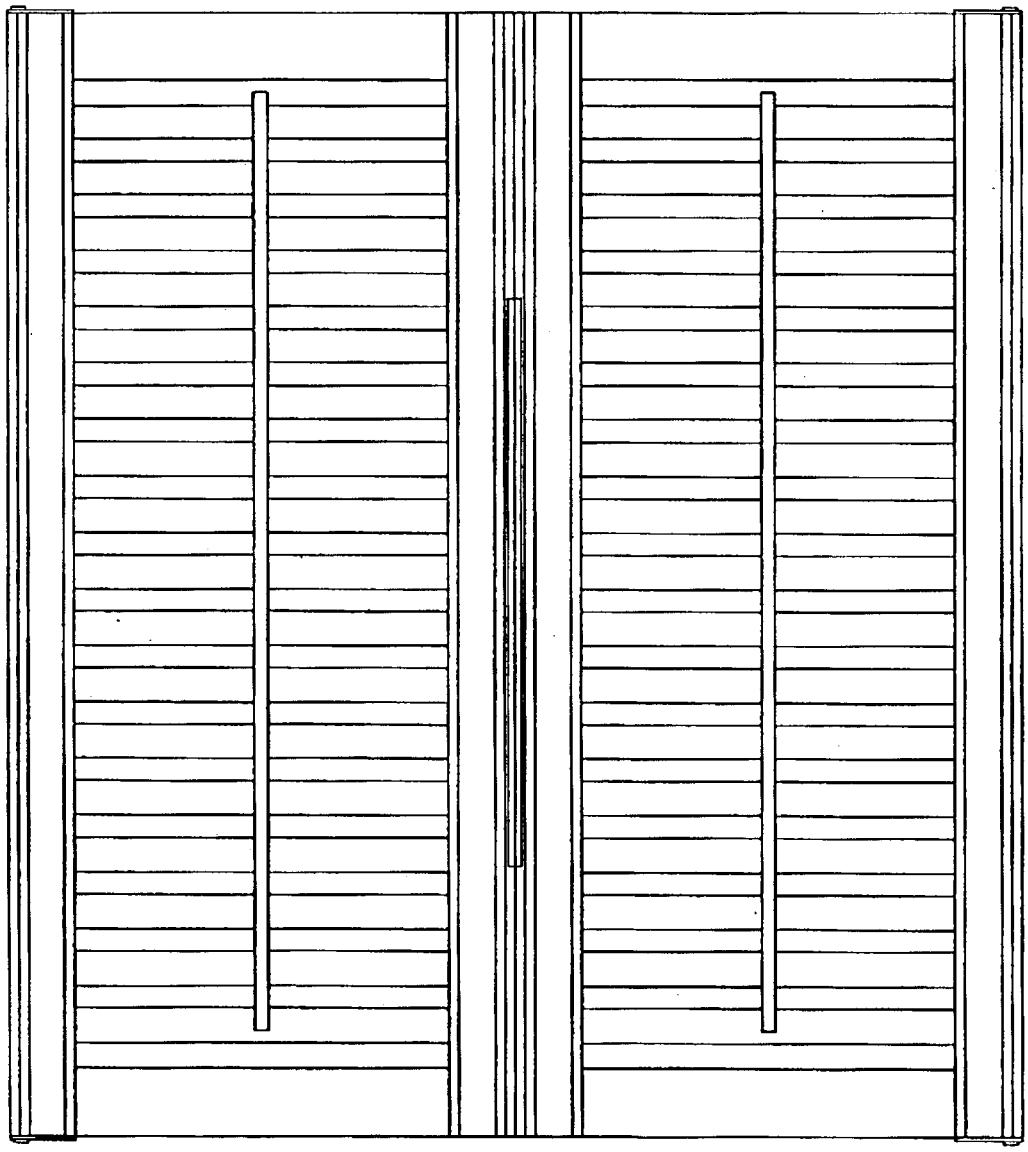
FIG. 13 is a front view of a double-swing wooden shutter according to the present invention.

In the aforesaid first and second embodiments, the wooden shutter is a single-swing design. Alternatively, the wooden shutter can be a double-swing design as shown in FIG. 13.

The wooden shutter functions smoothly to provide all of the features discussed earlier. Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wooden shutter installed on a wall around a window, said wooden shutter comprising:

an outer frame having a receiving open space therein, a top mounting portion provided at a top distal end of a top outer side thereof, and a bottom mounting portion provided at a bottom distal end of a bottom outer side;

a plurality of louvers arranged in parallel in said receiving open space;

a first coupling unit having a mounting plate fixedly fastened to the wall around the window, and a fixed pivot member fixedly located on said mounting plate and pivoted to the bottom mounting portion of said outer frame; and a second coupling unit having a mounting plate fixedly fastened to the wall around the window, and a movable pivot member detachably installed in the mounting plate of said second coupling unit and pivoted to the top mounting portion of said outer frame enabling said outer frame to be turned in and out of the window.

2. The wooden shutter as claimed in claim 1, wherein said top mounting portion and said bottom mounting portion of said outer frame are recessed portions having a predetermined depth and width; said fixed pivot member is a round pivot pin integral with the mounting plate of said first coupling unit; the mounting plate of said second coupling unit has a through hole adapted to receive said movable pivot member; said movable pivot member is a round pivot pin for detachably inserting through the through hole of the mounting plate of said second coupling unit into the bottom mounting portion of said outer frame to pivotally connect said outer frame to the mounting plate of said second coupling unit.

3. The wooden shutter as claimed in claim 1, wherein said first coupling unit further comprises a wear resistant packing pad of low friction coefficient provided between the bottom mounting portion of said outer frame and the mounting plate of said first coupling unit; said second coupling unit further comprises a wear resistant packing pad of low friction coefficient provided between the top mounting portion of said outer frame and the mounting plate of said second coupling unit.

4. The wooden shutter as claimed in claim 1, wherein the mounting plate of said first coupling unit comprises a mounting portion for fastening to the wall around the window and a bearing portion for fastening to said outer frame by said fixed pivot member, the mounting portion of the mounting plate of said first coupling unit having a plurality of mounting holes for the mounting of fastening elements to fixedly secure the mounting plate of said first coupling unit to the wall around the window; the mounting plate of said second coupling unit comprises a mounting portion for fastening to the wall around the window and a bearing portion for fastening to said outer frame by said movable pivot member, the mounting portion of the mounting plate of said second coupling unit having a plurality of mounting holes for the mounting of fastening elements to fixedly secure the mounting plate of said second coupling unit to the wall around the window; said movable pivot member is insertable through the bearing portion of the mounting plate of said second coupling unit into connection with the top mounting portion of said outer frame.

5. The wooden shutter as claimed in claim 4, wherein the mounting plate of said first coupling unit is a L-shaped tough plate having the mounting portion and bearing portion thereof connected at right angles, the mounting plate of said second coupling unit is a L-shaped tough plate having the mounting portion and bearing portion thereof connected at right angles.

6. The wooden shutter as claimed in claim 4, wherein the mounting plate of said first coupling unit is a planar tough plate having the bearing portion thereof protruded from one corner of the mounting portion thereof; the mounting plate of said second coupling unit is a planar tough plate having the bearing portion thereof protruded from one corner of the mounting portion thereof.

7. The wooden shutter as claimed in claim 4, wherein said fixed pivot member is a round pivot pin integral with the bearing portion of the mounting plate of said first coupling unit, the bearing portion of the mounting plate of said second coupling unit has a through hole for receiving said movable pivot member.

8. The wooden shutter as claimed in claim 4, wherein the bearing portion of the mounting plate of said first coupling unit defines a boundary having a first side, a second side, a third side, and a fourth side, said first side joining the mounting portion of the mounting plate of said first coupling unit, said second side being opposite to said first side, said third side being connected between said first side and said second side at an inner side, said fourth side being connected between said first side and said second side at an outer side opposite to said third side; when said outer frame turned to the inside of said window, the border of the bottom end of said side forming said bottom mounting portion of said outer frame defines a fifth side, a sixth side, a seventh side, and an eighth side corresponding to said first side, said second side, said third side, and said fourth side respectively, wherein the distance between the axis of said fixed pivot member and said first side is greater than the distance between the center of said bottom mounting portion of said outer frame and the connection area between said fifth side and said eighth side.

9. The wooden shutter as claimed in claim 8, wherein the distance between the axis of said fixed pivot member and said fourth side is shorter than the distance between the center of said bottom mounting portion to said eighth side.

10. The wooden shutter as claimed in claim 8, wherein the distance between the axis of said fixed pivot member and said second side is shorter than the distance between the center of said bottom mounting portion to said sixth side.

11. The wooden shutter as claimed in claim 1, wherein said outer frame is comprised of a transverse top block, a first stile, a second stile, and a transverse bottom block; said top mounting portion and said bottom mounting portion are respectively formed in top and bottom ends of said first stile.

12. The wooden shutter as claimed in claim 11, wherein said first stile and said second stile each have a decorative design of raised lines.

13. The wooden shutter as claimed in claim 11, wherein said top mounting portion and said bottom mounting portion are respectively formed in top and bottom ends of said first stile in close proximity to front and outer sides of said first stile.

14. The wooden shutter as claimed in claim 1 further comprising an elastic packing strip provided between the wall around said window and said outer frame.

* * * * *